US011697866B2

(12) United States Patent
Skubich et al.

(10) Patent No.: US 11,697,866 B2
(45) **Date of Patent: *Jul. 11, 2023**

(54) MANUFACTURING PROCESS FOR OBTAINING HIGH STRENGTH EXTRUDED PRODUCTS MADE FROM 6XXX ALUMINIUM ALLOYS

(71) Applicant: CONSTELLIUM VALAIS SA (AG-LTD), Sierre (CH)

(72) Inventors: Alexis Skubich, Zurich (CH); Martin Jarrett, Oxfordshire (GB)

(73) Assignee: CONSTELLIUM SINGEN GmbH, Singen (DE)

( * ) Notice: Subject to any disclaimer, the term of this patent is extended or adjusted under 35 U.S.C. 154(b) by 833 days.

This patent is subject to a terminal disclaimer.

(21) Appl. No.: 15/100,793

(22) PCT Filed: Nov. 27, 2014

(86) PCT No.: PCT/EP2014/003170

§ 371 (c)(1),
(2) Date: Jun. 1, 2016

(87) PCT Pub. No.: WO2015/086116

PCT Pub. Date: Jun. 18, 2015

(65) Prior Publication Data

US 2016/0304994 A1 Oct. 20, 2016

(30) Foreign Application Priority Data

Dec. 11, 2013 (EP) ..... 13005757

(51) Int. Cl.

| | |
|---|---|
| ***C22F 1/05*** | (2006.01) |
| ***C22C 21/08*** | (2006.01) |
| ***C22C 21/02*** | (2006.01) |
| ***C22F 1/043*** | (2006.01) |
| ***C22F 1/04*** | (2006.01) |
| ***C22F 1/047*** | (2006.01) |
| ***B21C 23/00*** | (2006.01) |
| ***B22D 21/00*** | (2006.01) |

(52) U.S. Cl.

CPC ..... *C22C 21/02* (2013.01); *B21C 23/002* (2013.01); *B22D 21/007* (2013.01); *C22C 21/08* (2013.01); *C22F 1/04* (2013.01); *C22F 1/043* (2013.01); *C22F 1/047* (2013.01); *C22F 1/05* (2013.01)

(58) Field of Classification Search

CPC ..... C22C 21/08; C22F 1/05
See application file for complete search history.

(56) References Cited

U.S. PATENT DOCUMENTS

| | | | | |
|---|---|---|---|---|
| 3,990,922 | A | 11/1976 | Gullotti et al. | |
| 4,909,858 | A | 3/1990 | Reiso | |
| 5,027,634 | A | 7/1991 | Visser | |
| 2003/0226935 | A1 | 12/2003 | Garratt et al. | |
| 2004/0084119 | A1 | 5/2004 | Sano et al. | |
| 2013/0319585 | A1* | 12/2013 | Parson | C22C 21/02 148/690 |
| 2014/0123719 | A1* | 5/2014 | Lukasak | C22C 21/08 72/253.1 |
| 2016/0304994 | A1* | 10/2016 | Skubich | C22C 21/02 |

FOREIGN PATENT DOCUMENTS

| | | | |
|---|---|---|---|
| EP | 0 302 623 | | 2/1989 |
| JP | 04341546 | A * | 11/1992 |
| JP | H073409 | A | 1/1995 |

OTHER PUBLICATIONS

Reiso, O. "Extrusion of AlMgSi Alloys", Proceedings of the 9th International Conference on Aluminum Alloys, p. 32-46. (Year: 2004).*

Davis, J.R. ASM Specialty Handbook: "Aluminum and Aluminum Alloys", p. 22, 23, 68, 69. (Year: 1993).*

(Continued)

*Primary Examiner* — George Wyszomierski
*Assistant Examiner* — Janell C Morillo
(74) *Attorney, Agent, or Firm* — McBee Moore & Vanik IP, LLC

(57) ABSTRACT

A manufacturing process for obtaining extruded products made from a 6xxx aluminium alloy, wherein the said manufacturing process comprises following steps:

a) homogenizing a billet cast from said aluminium alloy;

b) heating the said homogenised cast billet;

c) extruding the said billet through a die to form at least a solid or hollow extruded product;

d) quenching the extruded product down to room temperature;

e) optionally stretching the extruded product to obtain a plastic deformation typically between 0.5% and 5%;

f) ageing the extruded product without applying on the extruded product any separate post-extrusion solution heat treatment between steps d) and f).

characterised in that:

i) the heating step b) is a solution heat treatment where:

b1) the cast billet is heated to a temperature between Ts-15° C. and Ts, wherein Ts is the solidus temperature of the said aluminium alloy;

b2) the billet is cooled until billet mean temperature reaches a value between 400° C. and 480° C. while ensuring billet surface never goes below a temperature substantially close to 400° C.;

ii) the billet thus cooled is immediately extruded (step c)), i.e. a few tens seconds after the end of step b2).

14 Claims, No Drawings

(56) References Cited

OTHER PUBLICATIONS

International Search Report dated Oct. 2, 2015, in counterpart International Application No. PCT/EP2014/003170.
Couper et al., "Effect of homogenization temperature and time on billet microstructure and extruded properties of alloy 6061" Aluminium Cast House Technology. (Jan. 1, 2001) pp. 287-296.
Parson et al., "The effect of heat treatment on the microstructure and properties of 6000 series alloy extrusion ingots" Metals and Materials Society. (Jan. 1, 1989) pp. 713-724.
European Search Report dated Mar. 18, 2014, issued in counterpart European Application No. EP 13 00 5757.
Reiso, Oddvin. "The Effect of Billet Preheating Practice on Extrudability of AlMgSi Alloys" Proceedings of Fourth International Technology Seminar. (Apr. 1988) vol. 2: 287-295.
Verhoeven, John D. "Diffusion, Automistic Approach", Fundamentals of Physical Metallurgy. (1975) pp. 138, 139, 154, and 155.
"Understanding Extruded Aluminum Alloys" ALcOA Engineered Products. (Dec. 2002) pp. 1-2.
"Manufacturing process for obtaining high strength extruded products made from aluminum alloys" Constellium Valais SA AG Ltd. (Nov. 12, 2013) p. 1-5. Third Party Observation for Application No. EP20130005757, submitted Jun. 27, 2016.
"International Alloy Designations and Chemical Composition Limits for Wrought Aluminum and Wrought Aluminum Alloys," pp. 1-29, Feb. 2009, the Aluminum Association, Arlington, VA.
"Tempers for Aluminum and Aluminum Alloy Products," pp. 1-45, Jul. 2011, The Aluminum Association, Arlington, VA.
Jenister, "Taper Quenching, A Case Study," pp. 83-87, May 16-19, 2000, Proceedings of the Seventh International Aluminum Extrusion Technology Seminar, Chicago, Illinois.
Sano, "Properties of Hollow Extrusion of High Strength Al—Mg—Si—Cu Alloy for Aircraft," pp. 413-418, Jul. 5-10, 1998, The Japan Institute of Light Metals, Toyohashi, Japan
O. Reiso, "The Effect of Billet Preheating Practice on Extrudability of AlMgSi Alloys" In Proceedings of the Fourth International Aluminum Extrusion Technology Seminar, Chicago, IL, USA 1988, 2:287-295.
Katharina Strobel et al., "Relating Quench Sensitivity to Microstructure in 6000 Series Aluminium Alloys", Materials Transactions, 2011, pp. 914 to 919, vol. 52, No. 5.
Pradip K. Saha, "Aluminun Extrusion Technology", ASM International, 1999-2000.
Hugh J. McQueen et al., "Chapter 6—Precipitation Hardening Alloys", Hot Deformation and Processing of Aluminum Alloys, CRC Press—Taylor & Francis Group, LLC, 2011.
Professor T. Sheppard, "Extrusion of Aluminium Alloys", Department of Product Design and Manufacture, Bournemouth University, Springer Science+Businnes Media Dordrecht, 1999.
B. Rinderer, "The metallurgy of homogenisation," Materials Science Forum, (2011), vol. 693, 264-275.

* cited by examiner

MANUFACTURING PROCESS FOR OBTAINING HIGH STRENGTH EXTRUDED PRODUCTS MADE FROM 6XXX ALUMINIUM ALLOYS

CROSS REFERENCE TO RELATED APPLICATIONS

This application is a § 371 National Stage Application of PCT/EP2014/003170, filed Nov. 27, 2014, which claims priority to EP 13005757.3, filed Dec. 11, 2013.

BACKGROUND

Field of the Invention

The invention relates to a manufacturing process for obtaining AA6xxx-series aluminium alloy extruded products having particularly high mechanical properties, typically an ultimate tensile strength higher than 375 MPa, preferably 400 MPa, in both solid and hollow form without the need for a post-extrusion solution heat treatment operation.

Description of Related Art

Unless otherwise stated, all information concerning the chemical composition of the alloys is expressed as a percentage by weight based on the total weight of the alloy. "6xxx aluminium alloy" or "6xxx alloy" designate an aluminium alloy having magnesium and silicon as major alloying elements. "AA6xxx-series aluminium alloy" designates any 6xxx aluminium alloy listed in "International Alloy Designations and Chemical Composition Limits for Wrought Aluminum and Wrought Aluminum Alloys" published by The Aluminum Association, Inc. Unless otherwise stated, the definitions of metallurgical tempers listed in the European standard EN 515 will apply. Static tensile mechanical characteristics, in other words, the ultimate tensile strength $R_m$ (or UTS), the yield strength at 0.2% plastic elongation $R_{p0,2}$ (or YTS), and elongation A % (or E %), are determined by a tensile test according to NF EN ISO 6892-1.

High strength 6xxx aluminium alloy extruded products (e.g. AA6082, AA6182, AA6056, AA6061, . . . ) are currently produced by a manufacturing process, such as the following one, which comprises:

a) homogenizing a cast billet by holding the billet several hours, typically between 3 and 10 hours, at a temperature between 0° C. and 75° C. lower than solidus—which is near 575° C.-585° C. for such alloys—and cooling the homogenized cast billet to room temperature;

b) heating the homogenised cast billet to a temperature 20° C. to 150° C. lower than solidus temperature;

c) extruding the said billet through a die to form at least one solid or hollow extruded product with an extrusion speed such that the surface temperature of the extrudate reaches the solid solution temperature, which is higher than 520° C. but lower than solidus, commonly ranging from 530° C. to 560° C., in order to avoid incipient melting due to non-equilibrium melting of precipitates formed from solute elements (e.g. Mg2Si, Al2Cu) in profile hot-spots but still allow to dissolve part of the aforementioned phases that will later contribute to hardening the alloy by re-precipitation during ageing;

d) quenching the extruded product with an intense cooling device down to room temperature;

e) stretching, typically between 0.5% and 5%, the extruded product to obtain a straight stress-relieved profile;

f) ageing the extruded product by a one- or multiple-step heat treatment at temperatures ranging from 150 to 200° C. for a prescribed time of period, between 1 and 100 hours, depending on the targeted property(ies), for example the highest ultimate strength which can be obtained by this way.

Thin section profiles, typically products having a thickness lower than 3 mm, which are extruded with this processing route, have a partially recrystallized structure at least in most part of their cross-section, especially at the extrudate surface, such that their ultimate tensile strength cannot reach a maximum value higher than approximately 370 MPa in the case of copper-free 6xxx alloys and 380 MPa for copper containing 6xxx alloys.

For ultra-high strength requirements, alloying elements such as Si, Mg and Cu should be added to form precipitated hardening phases but the resulting alloy compositions are significantly zo less easy to extrude, because of the limited capability to dissolve the precipitated phases resulting from the solute additions using conventional billet heating and press solutionising and quenching practices as described above (steps c) and d)). Indeed, the addition of alloying elements results in a significant decrease in solidus to solvus range, which becomes a narrow "window". Practically, the solidus to solvus window is less than 10° C.-20° C. for alloys with high Mg2Si content, typically comprised between 1.2 and 1.6% and Si excess up to 0.7 wt. %, especially if Si excess is between 0.2 wt. % and 0.7 wt. %. Si excess is evaluated by Si−Mg/1.73−0.3*(Fe+Mn), where Si, Mg, Fe and Mn contents are in wt. %. This solidus to solvus window is particularly narrow (less than approx. 10° C.) if Cu content lies between 0.4 and 1.5 wt. %. Such a narrow solidus to solvus window compromises extrudability through premature hot-tearing: if the exit temperature is too high, the material suffers hot cracks on exit from the die and if it is too low, the dissolution of the precipitates resulting from the solute additions does not occur, which is necessary to provide the required strength after natural or artificial ageing.

In such circumstances, the application of a separate solution heat treatment should be applied after extrusion and before ageing. A separate post-extrusion solution heat treatment is therefore essential for obtaining hard 6xxx aluminium alloy extrusions for the reasons described above. Typically this involves the insertion of additional process steps between steps e)-or d), in the case where e) were not carried out-and f):

e') solution heat treating the extruded product for a defined period of time e.g. 15 to 60 minutes for a 6xxx alloy at a temperature higher than the extrusion exit temperature (typically 530-560° C.), as there is this time no temperature-gradients in the profile that could lead to incipient melting in hot-spots.

e") quenching the solution heat treated extruded product down to room temperature.

A separate post-extrusion solution heat treatment is thus applied to the extrudate, which increases the dissolution of phases constituted by precipitation of solute elements and present in the as-quenched temper. The extrudate is then aged (step g)) and can raise a strength level higher than if it is not post-extrusion solution heat treated. However, the gain is less than expected, because the structure of the extrudate resulting from this separate post-extrusion solution heat treatment is generally partially recrystallized, which lead to a more or less significant drop in mechanical properties, depending among other parameters on the chemistry of the alloy.

Moreover, for AA6xxx profile sections having thin walls, e.g. sections having a mean thickness substantially lower than 3 mm, this additional separate post-extrusion solution heat treatment step presents a number of major disadvantages, i.e. increased manufacturing costs, poor geometrical capability due to profile distortion and risk of recrystallization during the solution heat treatment that leads to a significant drop in mechanical properties.

JPH73409 describes a manufacturing process for obtaining extruded products made of an aluminum alloy, the composition of which is defined with broad content ranges such that it encompasses usual high strength aluminium alloys such as AA6082, AA6182, AA6061, AA6056, etc. This process consists in heat treating the billet 1-30 hr. at a temperature between 150° C. and 300° C. before the homogenization step (5 hours at soaking temperature 560° C.), the heating rate being below 300° C./hr before each stage and then cooling to room temperature with a cooling rate below 150° C./hr. According to this patent application, slightly higher ultimate tensile strengths can be obtained when carrying out this, which includes obligatorily a separate post-extrusion solution treatment operation. However, the ultimate tensile strengths thus obtained are lower than 390 MPa for copper-free alloys and 410 MPa for copper-containing alloys.

SUMMARY

The applicant decided to develop a method for manufacturing ultra-high strength AA6xxx alloy extrusions, which are obtained with an acceptable extrusion speed in both solid and hollow form and have an ultimate tensile strength higher than 380 MPa for copper-free AA6xxx alloys and 400 MPa for copper-containing AA6xxx alloys, without the need for an additional post-extrusion solution treatment operation, even if their wall thickness is less than 3 mm.

A first object of the invention is a manufacturing process comprising following steps:

a) homogenizing a billet cast from a 6xxx aluminium alloy;

b1) solution heat treating the said homogenised cast billet to a temperature between Ts-15° C. and Ts, wherein Ts is the solidus temperature of the said alloy;

b2) cooling until billet temperature reaches 400° C. to 480° C. while ensuring billet surface never goes below a temperature substantially close to 400° C. to avoid any precipitation of constituent particles, such as Mg2Si or Al2Cu particles;

c) extruding immediately, i.e. a few tens seconds after the cooling operation, the said billet through a die to form at least a solid or hollow extruded product with an extrusion speed such that the surface temperature of the extrudate is higher than 460° C. and lower than solidus, commonly ranging from 500° C. to 560° C.;

d) quenching the extruded product down to room temperature;

e) optionally stretching the extruded product to obtain a plastic deformation typically between 0.5% and 5%;

f) ageing the extruded product without beforehand applying on the extruded product any separate post-extrusion solution heat treatment.

DETAILED DESCRIPTION OF A PREFERRED EMBODIMENT

The process according to the invention consists in replacing conventionally heating AA6xxx alloy billets with overheating and quenching them from the very high temperature of the solution heat treatment to the extrusion temperature. According to the present invention, following steps—extruding, press-quenching and ageing to achieve the targeted property, in particular an ultra-high ultimate strength—do not necessarily comprise a separate post-extrusion solution heat treatment, because, as a result of steps b1) and b2), most part of the alloying elements which contribute to the formation of hardening particles are in solid solution in the lattice of the extrudate.

The present invention therefore provides a process to extrude a range of 6xxx alloys with superior mechanical properties, especially if applied to a sufficiently copper-doped AA 6182, with strength levels in excess of 400 MPa, hitherto not achieved through a conventional "press quenched" route. In addition, good extrudability is maintained because the limitation with extrusion speed due to premature speed cracking resulting from incipient melting is minimised due to a stronger level of solutionising of phases constituted by precipitation of solute elements prior to extrusion.

According to the invention, a billet is provided resulting from casting a 6xxx aluminium alloy, i.e. an aluminium alloy having magnesium and silicon as major alloying elements. Preferably, this aluminium alloy is a high-strength 6xxx aluminium alloy, such as AA6082, AA6182, AA6056, AA6061 or any copper-doped and/or zinc-doped alloy derived from the said AA6xxx aluminium alloys. Typically, the composition of the alloy comprises: Si: 0.3-1.7 wt. %; Mg: 0.1-1.4 wt. %; Mn: 0.1-1.4 wt. %; and, preferably, at least one of Cu: 0.01-1.5 wt. % and Zn: 0.01-0.7 wt. %, the rest being aluminium and inevitable impurities.

This alloy has preferably a high Cu content, typically between 0.4 and 1.5 wt. %, more preferably between 0.4 and 1.2 wt. %, even more preferably between 0.4 and 0.7 wt. %. At least one dispersoid element is advantageously added, such as Mn 0.15-1 wt. %, Cr 0.05-0.4 wt. % or Zr 0.05-0.25 wt. %—to control recrystallization and maximize the retention of fibrous structure of the extrudate.

The cast billet is homogenised. The homogenisation treatment may follow a conventional route, i.e. between 3 and 10 hours at a temperature between 0° C. and 75° C. lower than solidus. However, because of the solution heat treatment step b1) according to the invention, the homogenisation temperature is advantageously between 50° C. and 150° C., preferably between 80° C. and 150° C. lower than solidus, typically in the range 450° C.-500° C. for AA6xxx alloys. The homogenised billet is then cooled down to room temperature.

The homogenised cast billet to be extruded is heated to a soaking temperature slightly below the solidus temperature Ts to be solution heat treated. According to the invention, the soaking temperature of the solution heat treatment is between Ts-15° C. and Ts. For example, solidus temperature is near 575° C. for alloys AA6082 and AA6182 and near 582° C. for AA6061. The billets are preferably heated in induction furnaces and hold at the soaking temperature during ten seconds to several minutes, typically between 80 and 120 seconds.

The billet is then cooled until its temperature reaches 400° C. to 480 ° C. while ensuring that the billet surface never goes below a temperature substantially close to 400° C. to avoid any precipitation of constituent particles, in particular hardening particles such as Mg2Si or Al2Cu. In other words, according to the invention, the mean temperature of the billet should be controlled, which implies that the cooling step has to follow an operating route, which should be pre-defined, for example by experimentation or through numerical simulation in which at least the billet geometry, the thermal conductivity of the alloy at different temperatures and the heat transfer coefficient associated with the cooling means are taken into account.

FEM simulation of the cooling of a ⌊ 254 mm diameter billet with a heat transfer coefficient of 1 $kW/m^2/°$ K shows that the cooling should be stopped after approximately 40 s to avoid that the billet surface is below 400° C. At that time, the temperature of billet core is still near 530° C. but 40 seconds later, the temperature is again almost homogeneous in the billet, i.e. approximately 480° C. in the core and near the surface, because of the high thermal conductivity of the aluminium alloy.

For billets having higher diameters, the cooling means should have higher cooling power or, if the same cooling means is used, cooling should be made in several steps including intense cooling, cooling stop when surface temperature is near 400° C., holding the billet few seconds such that the core and the surface temperatures are close each to the other and start a new similar cooling step as long as the mean temperature of the billet is higher than 480° C.

For billets having lower diameters, cooling means can be used, which has lower cooling power or, if the same cooling means is used, cooling should be stopped after a shorter time, which can be estimated by an appropriate numerical simulation.

As soon as the billet temperature reaches a temperature between 400° C. to 480° C., i.e. a few tens seconds after the cooling operation is stopped, the billet is introduced in the extrusion press and extruded through a die to form one or several solid or hollow extruded products or extrudates. The extrusion speed is controlled to have an extrudate surface exit temperature higher than 460° C. but lower than solidus temperature Ts. The exit temperature may be quite low, because, as a result of steps b1) and b2), alloying elements forming hardening precipitates are still in solution in the aluminium lattice. The exit temperature should be high enough to merely avoid precipitation. Practically, the targeted extrudate surface temperature is commonly ranging from 530° C. to 560° C., to have an extrusion speed compatible with a satisfying productivity.

The extruded product is then quenched at the exit of the extrusion press, i.e. in an area located between 500 mm and 5 m of the exit from the die. It is cooled down to room temperature with an intense cooling device, e.g. a device projecting sprayed water on the extrudates. The extrudates are then optionally stretched to obtain a plastic deformation typically between 0.5% and 5%, in order to have stress-relieved straight profiles.

The profiles are then aged without any prior post-extrusion solution heat treatment, by a one- or multiple-step heat treatment at temperature(s) ranging from 150 to 200° C. for a prescribed period of time, between 1 to 100 hours, depending on the targeted properties. The zo process according to the invention is particularly well suited to obtain T6 temper or T66 temper, which corresponds to the highest possible value of the ultimate strength of the alloy, possibly higher than the highest ultimate strength obtained by conventionally heating the billet and subjecting the extrudate to a post-extrusion solution heat treatment.

The process according to the invention allows obtaining press-quenched extruded products made from Cu-doped 6xxx alloys, which were until now very difficult, even almost impossible to extrude because of their very narrow solvus-solidus temperature window. This process is particularly well suited to alloys with $Mg_2Si$ content comprised between 1.2 wt. % and 1.6 wt. %, Si excess up to 0.7%, particularly if comprised between 0.2 wt. % and 0.7 wt. %, and especially if copper content lies between 0.4 wt. % and 1.5 wt. %, which gives a solvus to solidus temperature range approximately equal to or even lower than 10° C., and renders such alloy almost impossible to extrude.

If this alloy comprises additionally a dispersoid element such as zirconium, typically between 0.05 and 0.25 wt. %, the microstructures of the extrudates show a strong fibrous retention providing an additional strengthening contribution, considered important in meeting such high mechanical property values. After having applied the process according to the invention to Cu-doped AA6182 aluminium alloys, the applicant was able to obtain 3 mm thick extrudates having at T6 temper ultimate tensile strengths higher than 410 MPa, even higher than 425 MPa.

Another object of the invention is a product extruded from a 6xxx aluminium alloy, in particular a hollow extruded profile, having a thickness lower than 6 mm, preferably lower than 3 mm, typically ranging from 1.5 mm to 3 mm, which is aged to a T6 temper to obtain an ultimate tensile strength higher than 380 MPa, preferably higher than 400 MPa, more preferably higher than 420 MPa. The 6xxx aluminium alloy may be AA6056, AA6156, Cu-doped (typiycally up to 1.5 wt. %) AA6056, Cu-doped (typically up to 1.5 wt. %) AA6156, Cu-doped (typically up to 1.5 wt. %, preferably up to 1.2 wt. %, more preferably up to 0.7 wt. %) AA6082 or Cu-doped (typically up to 1.5 wt. %, preferably up to 1.2 wt. %, more preferably up to 0.7 wt. %) AA6182.

Thus, by applying the method according to the invention to a defined range of 6xxx alloys, it has been demonstrated that mechanical properties in excess of 425 MPa can be achieved without the need for separate post-extrusion solution heat treatment. This provides a novel approach to the production of ultra high strength 6xxx alloy automotive structural components including bumpers, where conventional extrusion production limits the mechanical properties (UTS) to a 340 MPa maximum.

The minimum solute content is defined, for a given manufacturing process, as the minimum wt. % of constituent elements permitting to guarantee a given strength level. Under conventional manufacturing conditions, it takes into account the fact that solutionising step is generally partial: typically, 60-90% of constituent elements are in solid solution after quenching according to extrusion conditions, i.e. extrusion speed, extrusion exit temperature, etc. Under the conditions of the manufacturing process according to the invention, owing to the increase of the level of solutionising (typically 85-95%) and of its repeatability, the minimum wt. % of constituent elements to guarantee a given strength level can be strongly reduced vs. conventional manufacturing conditions without separate post-extrusion solution heat treatment and thereby the minimum solute content with the process according to the invention is lower.

The use of minimum solute and maximum fibre retention further provides the opportunity to reduce section wall thickness, providing an improved strength to weight ratio for automotive component part production.

EXAMPLE

Profiles made of six 6xxx aluminium alloys (A, B, C, D, E and F) were extruded by following two different process routes: the current prior art route and the route according to the invention. The chemical compositions of these alloys are shown on Table I. Alloy A is an AA6182 alloy. Alloys B and F are AA6082 alloys. Alloy C is an AA6056 alloy. Alloys D and E are Cu-doped AA6182 alloys.

TABLE I

| Alloy | Si | Mg | Mn | Fe | Zr | Cu |
|---|---|---|---|---|---|---|
| A | 1.29 | 0.87 | 0.55 | 0.19 | 0.14 | 0.004 |
| B | 1.25 | 0.86 | 0.77 | 0.18 | — | 0.06 |
| C | 0.87 | 0.79 | 0.46 | 0.19 | — | 0.42 |
| D | 1.13 | 0.89 | 0.55 | 0.19 | 0.14 | 0.53 |
| E | 1.13 | 0.87 | 0.55 | 0.19 | 0.15 | 0.74 |
| F | 1.03 | 0.60 | 0.44 | 0.21 | — | — |

Homogenized cast billets having a diameter of 72.5 mm and a length of 120 mm were heated, introduced into an extrusion press and pressed to form 35*3 flat bars.

Homogenized billets A-1, A-2, B-1, B-2, C-1, C-2, F-1 and F-2 were heated by following the current route, at a temperature ranging from 480° C. to 500° C. and then introduced into the container of the extrusion press. All billets were pressed against the same die to obtain 3 mm diameter extruded rods. The extrusion speed was controlled such that the surface exit temperature was higher than 530° C. and lower than solidus temperature. The extruded products were quenched down to room temperature with a cooling device spraying water on the profiles exiting from the extrusion press. They were then stretched 2% and aged at 170° C. Extrudates obtained from billets A-2, B-2, C-2 and F-2 were subjected to a separate post-extrusion solution heat treatment.

Table 2 shows the comparison between the ultimate tensile strengths Mr of the flat bars thus obtained. We may note that the ultimate tensile strength raised by 10-15% for alloys A, B and C but dropped significantly for alloy F, because of the recrystallization of most part of the cross-section of the flat bar. None of these profiles has strength higher than 400 MPa, even if submitted to a separate post-extrusion solution heat treatment. Moreover, copper-containing alloy C extrudates were obtained with an unfavourably low extrusion speed and had poor surface finish.

TABLE 2

| | alloy | | | | | | | |
|---|---|---|---|---|---|---|---|---|
| | A | | B | | C | | F | |
| extrudate | A-1 | A-2 | B-1 | B-2 | C-1 | C-2 | F-1 | F-2 |
| Rm (MPa) | 350 | 385 | 360 | 395 | 345 | 385 | 350 | 275 |

Homogenized billets A-3, D and E were solution heat treated by following the route according to the invention, 100 seconds at a soaking temperature near 570° C. They were then cooled with a water cooling device giving a heat transfer flow of approximately 1 kW/m$^2$/° C. until billet surface temperature reached 440° C. Few seconds later, thanks to the high thermal zo conductivity of aluminium, the temperature is almost homogeneous in the billet and lower than 480° C. The billets were introduced into the container of the extrusion press and extruded as described above to obtain 35*3 mm flat bars.

Table 3 shows the comparison between the ultimate tensile strengths Rm of the profiles obtained from alloys A, D and E obtained by the process according to the invention.

TABLE 3

| | A-3 | D | E |
|---|---|---|---|
| Rm | 381 MPa | 416 MPa | 426 MPa |

As regards copper-free alloy A, the process according to the invention allows to obtain extrudates having an ultimate strength as high as if obtained after a post-extrusion solution heat treatment. According to the invention, alloy A may be extruded in better conditions, since higher extrusion speeds are possible and there is no need to carry out an additional separate solution heat treatment to have satisfying mechanical properties.

As regards alloys D and E, the combination of high Mg2Si content, high excess Si content and the addition of up to 0.7% Cu, gives a very narrow solvus to solidus temperature range (approximately 10° C.), which renders these alloys almost impossible to extrude with a conventional route. According to the process of the invention, 6xxx aluminium alloys having a higher content of hardening alloying elements can be extruded, giving extrudates with very high mechanical property values, which were not met until now for 6xxx alloys. The microstructures show a strong fibrous retention providing an additional strengthening contribution, considered important in meeting such high mechanical property values.

Results obtained on alloys alloys D and E show that mechanical properties achieved in the T6 temper after manufacturing according to the invention were higher than those obtained with a separate solutionising step. In the case of copper additions higher than 0.5%, as a result of the combined effect of solutionising and fibre retention, ultimate tensile strength was found to be higher than 410 MPa.

The invention claimed is:

1. A manufacturing process for obtaining extruded products made from a 6xxx aluminium alloy, wherein said manufacturing process comprises:

a) homogenizing a billet cast from said aluminium alloy and then cooling the billet down to room temperature;

b) heating the homogenized cast billet;

c) extruding said billet through a die to form at least a solid or hollow extruded product;

d) quenching with a water quench the extruded product down to room temperature;

f) ageing the extruded product without applying on the extruded product any separate post-extrusion solution heat treatment;

wherein said 6xxx aluminium alloy comprises Si: 0.3-1.7 wt. %; Mg: 0.1-1.4 wt. %; Mn: 0.55-1.4%, and at least one dispersoid element comprising Cr (0.05-0.4 wt. %) or Zr (0.05-0.25 wt %), the rest being aluminium and inevitable impurities; and wherein:

i) the heating b) is a solution heat treatment where:

b1) the cast billet is heated to a temperature between Ts-15° C. and Ts, wherein Ts is the solidus temperature of said aluminium alloy and is at least 575° C.;

b2) the billet is cooled until billet mean temperature reaches a value between 400° C. and 480° C. while ensuring billet surface never goes below 400° C.;

ii) the billet thus cooled is immediately extruded in c after the end of b2.

2. The manufacturing process according to claim 1, wherein the ageing treatment is a one- or multiple-step heat treatment at a temperature between 150° C. and 200° C. for a prescribed period of time, defined to obtain maximum ultimate strength.

3. The manufacturing process according to claim 1, wherein said cast billet is homogenized in a) at a temperature between 80° C. and 150° C. lower than solidus.

4. The manufacturing process according to claim 3, wherein said cast billet is homogenized in a) at a temperature between 450° C.-500° C.

5. The manufacturing process according to claim 1, wherein Cu content is between 0.4 and 1.5 wt. %.

6. The manufacturing process according to claim 1, wherein $-1.2$ wt. $\% \leq Mg_2Si \leq 1.6$ wt. % and $-0.2$ wt. $\% \leq Si-Mg/1.73-(Fe+Mn)/3 \leq 0.7$ wt. %.

7. The manufacturing process according to claim 1, further comprising, between d) and f):

e) stretching the extruded product to obtain a plastic deformation.

8. The manufacturing process according to claim 7, wherein the plastic deformation is between 0.5% and 5%.

9. The manufacturing process according to claim 1, wherein said 6xxx aluminium alloy further comprises at least one of Cu: 0.01-1.5 wt. % and Zn: 0.01-0.7%.

10. The manufacturing process according to claim 9, wherein Cu is present.

11. The method according to claim 1, wherein the 6xxx aluminium alloy has a thickness lower than 6 mm.

12. The manufacturing method according to claim 1, wherein the 6xxx aluminium alloy comprises Cu, and the extruded product has an ultimate tensile strength higher than 400 MPa.

13. The manufacturing method according to claim 1 wehrein the extruded product has an ultimate tensile strength higher than 410 MPa.

14. A manufacturing process for obtaining extruded products made from a 6xxx aluminium alloy, wherein said manufacturing process comprises:

a) homogenizing a billet cast from said aluminium alloy and then cooling the billet down to room temperature;

b) heating the homogenized cast billet;

c) extruding said billet through a die to form at least a solid or hollow extruded product;

d) quenching the extruded product down to room temperature;

f) ageing the extruded product without applying on the extruded product any separate post-extrusion solution heat treatment;

wherein said 6xxx aluminium alloy comprises Si: 0.3-1.7 wt. %; Mg: 0.1-1.4 wt. %; Mn: 0.55-1.4%, and at least one dispersoid element comprising Cr (0.05-0.4 wt. %) or Zr (0.05-0.25 wt %), the rest being aluminium and inevitable impurities; and wherein:

i) the heating b) is a solution heat treatment where:

b1) the cast billet is heated to a temperature between Ts-15° C. and Ts, wherein Ts is the solidus temperature of said aluminium alloy and is at least 575° C.;

b2) the billet is cooled until billet mean temperature reaches a value between 400° C. and 480° C. while ensuring billet surface never goes below 400° C.;

ii) the billet thus cooled is immediately extruded in c after the end of b2, wherein the extruded product has an ultimate tensile strength higher than 380 MPa.

* * * * *